United States Patent [19]

Olson et al.

[11] Patent Number: 4,776,244

[45] Date of Patent: Oct. 11, 1988

[54] OPEN-END WRENCH

[75] Inventors: Gene E. Olson; Paul B. Lemens, both of Kenosha, Wis.

[73] Assignee: Snap-on Tools Corporation, Kenosha, Wash.

[21] Appl. No.: 874,397

[22] Filed: Jun. 16, 1986

[51] Int. Cl.[4] ..... B25B 13/02

[52] U.S. Cl. ..... 81/119; 81/124.2

[58] Field of Search ..... 81/119, 186, 121.1, 81/124.2

[56] References Cited

U.S. PATENT DOCUMENTS

| | | | |
|---|---|---|---|
| 2,652,735 | 9/1953 | Wilder | 81/119 |
| 2,685,219 | 8/1954 | Diebold | 81/119 |
| 3,242,775 | 3/1966 | Hinkle | 81/119 |
| 3,273,430 | 9/1966 | Knudsen et al. | 81/119 |
| 3,495,485 | 2/1970 | Knudsen et al. | 81/119 |
| 3,602,073 | 8/1971 | Siwersson | 81/119 |
| 3,620,107 | 11/1971 | Evans | 81/119 |
| 3,745,859 | 7/1973 | Evans et al. | 81/119 |
| 3,757,614 | 9/1973 | Evans | 81/119 |
| 3,762,244 | 10/1973 | Evans | 81/119 |
| 3,785,226 | 1/1974 | Ward | 81/119 |
| 3,850,057 | 11/1974 | Evans | 81/119 |
| 3,858,464 | 1/1975 | Evans | 81/119 |
| 3,881,377 | 5/1975 | Evans et al. | 81/186 |

*Primary Examiner*—Frederick R. Schmidt
*Assistant Examiner*—Maurina Rachuda
*Attorney, Agent, or Firm*—Emrich & Dithmar

[57] ABSTRACT

The open-end wrench has a pair of jaws with parallel planar jaw surfaces. In each jaw surface is a configured notch having a planar drive surface, a clearance surface and a spacing surface between the drive surface and the clearance surface. The two clearance surfaces are on segments of a circle having a diameter greater than the across-corners dimension of the fastener to be tightened by the wrench. The distance between the planes of the driving surfaces is slightly greater than the across-sides dimension of the fastener. The spacing surface in each notch is a segment of a circle having a relatively small radius of curvature and is tangent to the associated clearance surface.

15 Claims, 2 Drawing Sheets

OPEN-END WRENCH

BACKGROUND OF THE INVENTION

This invention generally relates to open-end wrenches, and specifically relates to such a wrench having formations in the jaw surfaces which enable engagement of a portion of each of two fastener sides without engaging any of the corners of the fastener.

The usual open-end wrench consists of an elongated handle and a wrenching head on either or both ends. The head includes two jaws respectively with planar jaw surfaces that engage opposite sides of a polygonal fastener.

To tighten or loosen a fastener, torque is applied, the resultant forces tending to spread the jaws and in certain instances cause them to break. The stress at any location on each jaw is directly proportional to the distance to the point at which the force is applied, such point being where the most significant contact between the jaw and the fastener side occurs. In the usual wrench, the force is essentially perpendicular to the jaw surfaces and is, therefore, maximized so as to increase the likelihood of spread of the jaws or breakage.

SUMMARY OF THE INVENTION

An important object of the present invention is to increase the torque strength of an open-end wrench by reducing the tendency of the jaws of such wrench to spread or break.

Another object is to change the angle between the direction of force and the jaw surfaces so as not to be 90°.

Another object is to provide an open-end wrench which does not round the corners of a fastener being tightened or loosened.

Another object is to provide an open-end wrench which has specially configured notches for driving a fastener, but can still be used in the usual way.

In summary, there is provided an open-end wrench for a fastener having a plurality of generally flat sides intersecting at a plurality of corners, the fastener having an across-sides dimension and an across-corners dimension, the open-end wrench comprising an elongated handle and a wrenching head carried thereby, the head including first and second jaws and a throat interconnecting the jaws, the jaws respectively including first and second planar jaw surfaces substantially parallel to each other and spaced apart a distance slightly greater than the across-sides dimension, the jaw surfaces respectively having first and second notches therein, each of the notches being defined by a drive surface and a clearance surface adjacent to the drive surface, the drive surfaces being substantially planar and substantially parallel to each other and spaced apart a distance slightly greater than the across-sides dimension, the length of each of the drive surfaces being short compared to the length of a flat side of the fastener, each of the drive surfaces being adapted to engage a portion of a selected side of the fastener near a corner thereof, the distance between the first and second clearance surfaces being slightly greater than the across-corners dimension so that the clearance surfaces cannot engage any portion of the fastener.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

DETAILED DESCRIPTION OF THE PREFERRED EMBODIMENT

Figure 1:
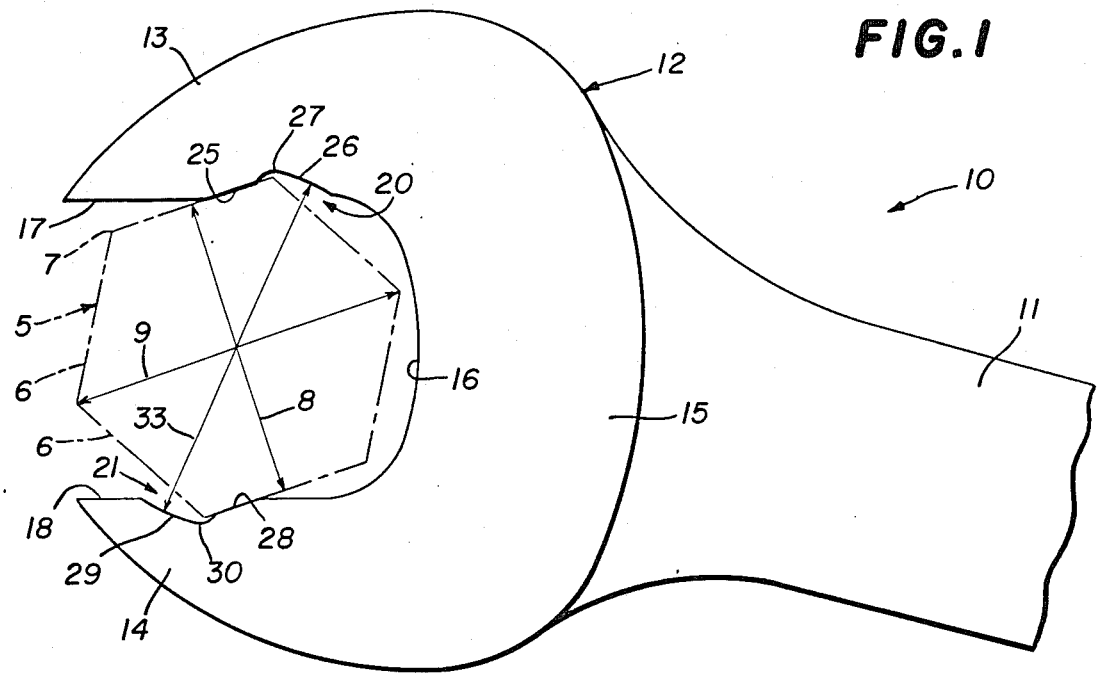
FIG. 1 depicts a fragmentary portion of an open-end wrench constructed in accordance with the features of the present invention, the outline of a hexagonal fastener being shown in phantom.

Referring now to the drawings, and more particularly to FIG. 1 thereof, there is depicted a fragment of an open-end wrench 10 incorporating the features of the present wrench. The wrench 10 includes an elongated handle 11 and a wrenching head 12. The head includes a pair of jaws 13 and 14 and a throat 15 interconnecting the jaws 13 and 14. The throat 15 has a forwardly facing curved surface 16 in the embodiment shown. The jaw 13 has a planar jaw surface 17 and the jaw 14 has a planar jaw surface 18.

The wrench 10 is adapted to loosen and to tighten a polygonal fastener, that is, a polygonal nut or bolt head. Depicted in the drawings is a hexagonal fastener 5 having six generally flat sides 6 intersecting at six corners 7. The fastener 5 has the standard dimensions of a hexagon and the angle between each pair of sides is about 120°. The external corners are often slightly rounded rather than as depicted. The fastener 5 has an across-sides dimension 8 and across-corners dimension 9.

The usual open-end wrench would be applied to the fastener 5 such that the jaw surfaces 17 and 18, respectively, engage opposite sides 6 of the fastener 5. The user, grasping the handle 11, would rotate same in order to tighten the fastener 5. As the fastener tightens, the torque increases and the resultant force tends to spread the jaws 13 and 14 and sometimes break them. To reduce that tendency, a notch 20 is formed in the jaw surface 17 and a notch 21 is formed in the jaw surface 18. The notches 20 and 21 are basically identical. The notch 20 includes a drive surface 25, a clearance surface 26 and a spacing surface 27 between the surfaces 25 and 26. The notch 21 includes a drive surface 28, a clearance surface 29 and a spacing surface 30 between the surfaces 28 and 29.

Figure 2:
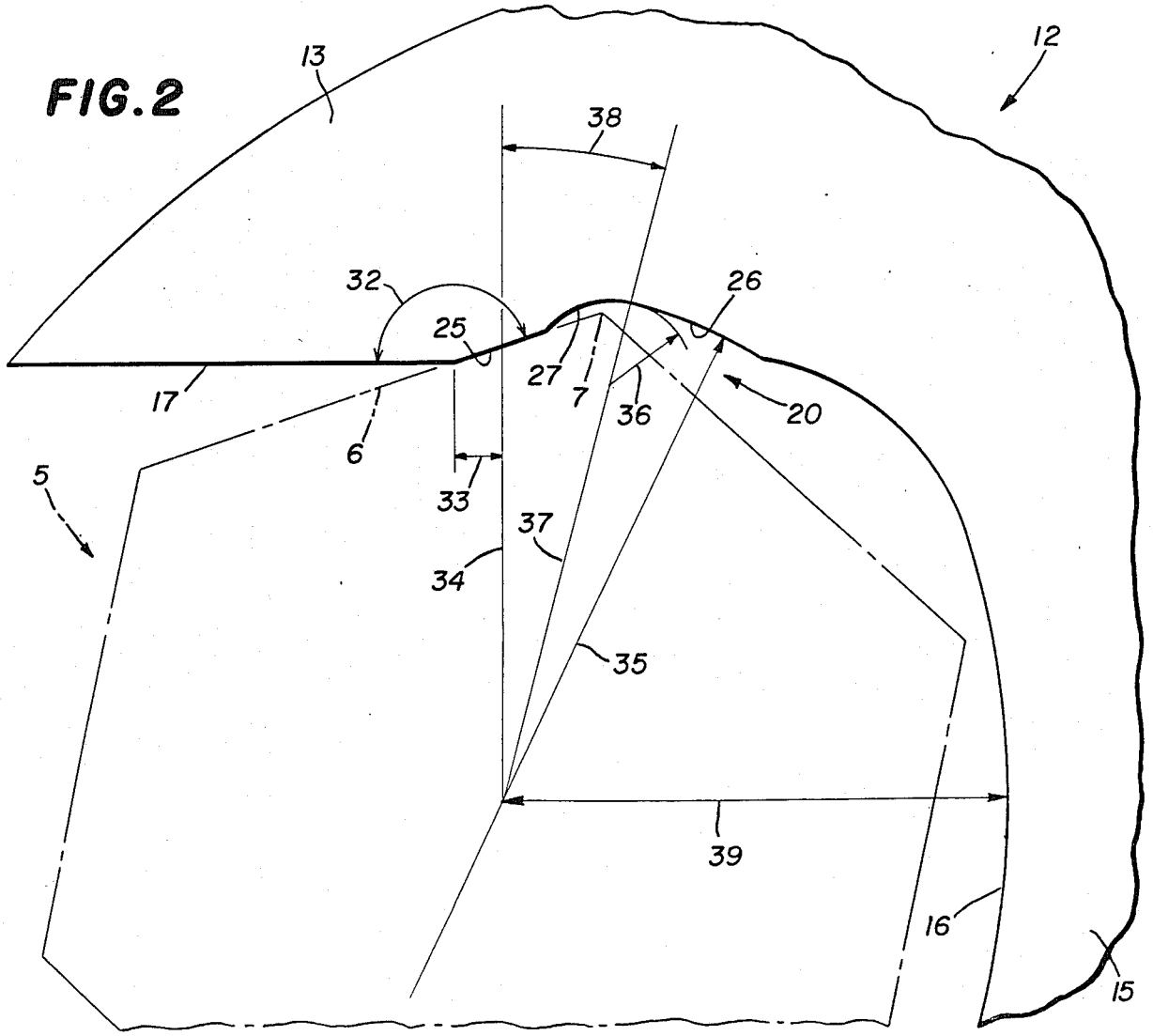
FIG. 2 is a greatly enlarged portion of the front of the upper jaw and the top of the fastener.

Referring to FIG. 2, the drive surface 25 is substantially planar, forms an obtuse angle 32 with the surface 17, and has a length that is short compared to the length of each side 6 of the fastener 5. The drive surface 25 intersects the jaw surface 17 a distance 33 from a line 34 that extends normal to the jaw surfaces 17 and 18 and passes through the center of the fastener 5. In an operative embodiment of the invention, the drive surface 25 represented about 17.5% of the length of each side 6 of the fastener 5. When the wrench 10 is rotated clockwise to wrench or drive the fastener 5, the drive surface 25 engages a portion of a selected side 6 near a corner 7 but is spaced slightly therefrom. The planar characteristic of the surface 25 causes substantially flat-to-flat driving engagement with the surface 6.

The clearance surface 26 is located beyond each corner 7 of the fastener. Preferably, the surface 26 is a segment of a circle having a diameter 35 which is slightly greater than the across-corners dimension of the fastener.

The spacing surface 27 is offset into the jaw 13 so that the jaw cannot contact any corner 7 of the fastener 5. To minimize stress concentration, it is preferred that the surface 27 be tangent to the clearance surface 26 at the line 37. In a preferred form, the surface 27 is a segment of a circle having a radius 36, the center of such circle being located on the line 37 at an acute angle 38 to the line 34. The distance 39 between the line 34 and the throat surface 16 is slightly greater than one half the across-corners dimension 9, and preferably is the same as the diameter 35.

An arcuate surface 27 has the attribute of no internal corners at which stress concentration can undesirably occur. Instead of being arcuate, the surface 27 could be compound, but that would be less desirable, as increased stress concentration is likely to take place. The greater the radius 36, the smaller the drive surface 25; the smaller the radius, the closer the drive surface 25 is to a corner of the fastener. The selection is a compromise, on the one hand, to maximize the length of the drive surface 25 and, on the other hand, to be sure that it is not too close to the corner.

Although the corner between the surfaces 25 and 27 is depicted as sharp, a blending radius can be incorporated between them.

The notch 21 has basically the same construction as the notch 20, except that it is rotated 180°. More specifically, the drive surface 28 is substantially identical to the drive surface 25, the clearance surfaces 26 and 29 are substantially identical, and the spacing surface 30 is substantially identical to the spacing surface 27. The drive surfaces 25 and 28 are substantially parallel to each other and are spaced apart a distance slightly greater than the across-sides dimension 8 (FIG. 1). When used to tighten a fastener 5, the drive surface 25 engages one side 6 while the drive surface 28 engages an opposing side 6. Each area of engagement takes place near a corner 7 but spaced slightly therefrom. The opposing flat-to-flat engagement provides sufficient surface-to-surface contact to tighten the fastener.

The distance between the clearance surfaces 26 and 29 is slightly greater than the across-corners dimension 9 so that the surfaces cannot contact any of the corners 7 of the fastener 5 to damage them. Preferably, both surfaces 26 and 29 are segments of a circle having the diameter 33, which is greater than the across-corners dimension 9.

As previously explained, the surfaces 26 and 29 are preferably segments of a circle. However, as can be seen in FIG. 2, such surfaces are very nearly flat. Accordingly, surfaces that are flat would also perform adequately, the main criterion being that the distance between them must exceed the cross-corners dimension.

The wrench 10 may be used in the usual way, that is, by causing the surfaces 17 and 18 to engage opposing sides 6 of the fastener 5. That is performed by applying the wrench 10 such that the surfaces 17 and 18 are parallel to the selected sides 6 and then moving the wrench forwardly. When the notches 20 and 21 are located as depicted in the drawings, the wrench must be backed off or pulled out slightly so that the notches 20 and 21 are not in line with the corners 7 of the fastener 5. Then, the entirety of the surface 17 would engage one of the sides 6. The opposite side 6 would be engaged by the surface 18, with the notch 21 located between the corners 7 at the ends of such side. The wrench can be rotated in one direction or the other to tighten or loosen the fastener, as the case may be.

In order to use the wrench 10 in accordance with the present invention, it is applied to the fastener 5 in the same way. With the notches 20 and 21 located as in the drawings, the wrench may be rotated, to cause two corners 7 to respectively enter the notches 20 and 21. The drive surfaces 25 and 28 will engage portions respectively of two opposite sides 6. The distance between the clearance surfaces 26 and 29 being greater than the across-corners dimension, the corners 7 are not contacted by the wrench. The spacing surfaces 27 and 30 being offset ensure that engagement of the drive surfaces 25 and 28 with the sides 6 is removed from the corners of the fastener.

Continued rotation of the wrench will cause the fastener to become tightened because of the force applied by the drive surfaces 25 and 28. Moreover, no contact is made between the wrench and any of the six corners 7 of the fastener, meaning the fastener corners will not become damaged as often occurs with an open-end wrench of standard construction.

The force is perpendicular to the surfaces 25 and 28. But, the moment is less and, therefore, the tendency for the jaws 13 and 14 to break is less. The smaller the angle 32, the less the moment and, of course, the less the tendency to break, but by the same token, the more difficult it is to use in a tight location. An angle 32 of 162° is a good compromise between improved resistance to breakage yet being practical to use.

Figure 3A:
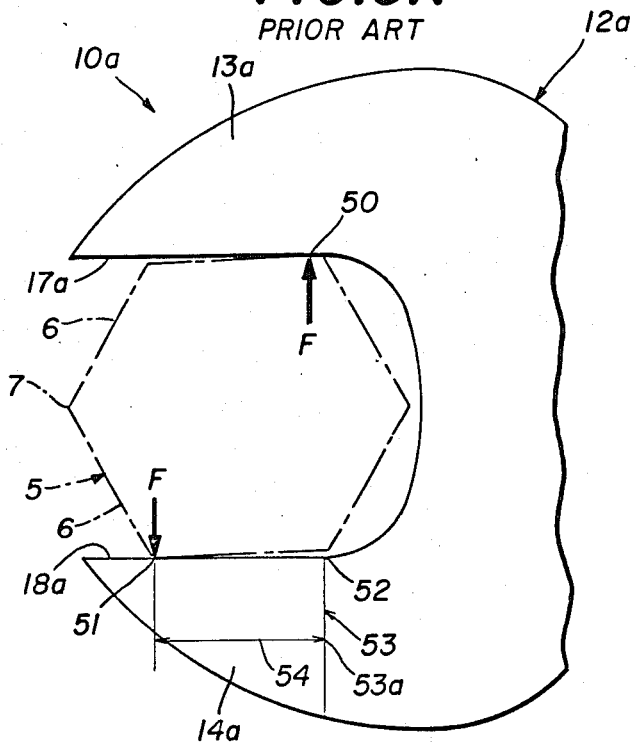
FIG. 3A PRIOR ART
FIG. 3A is an enlarged portion of a prior-art open-end wrench and depicting the lines of force when used to tighten the fastener.
Figure 3B:
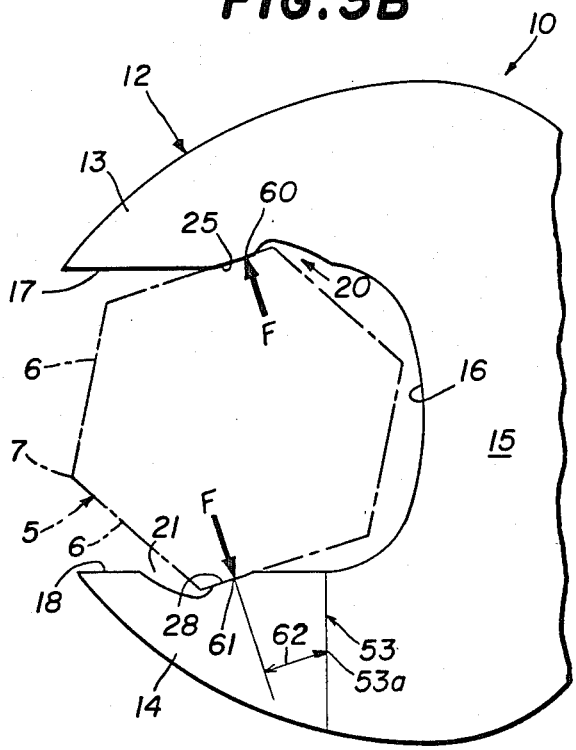
FIG. 3B is an enlarged portion of an open end-wrench constructed in accordance with the features of the present invention and depicting the lines of force when used to tighten the fastener.

The improved performance of the open-end wrench constructed in accordance with the features of the present invention is represented in FIGS. 3A and 3B. In FIG. 3A, there is depicted a standard open-end wrench 10*a* having a head 12*a*. As the fastener 5 is rotated, in the clockwise direction, an upwardly directed force F is applied to the point 50 on the jaw 13*a* and a force F is applied to the other jaw 14*a* at the point 51. The line 53 represents a plane that passes approximately transversely through that part of the jaw 14*a* that is under the most stress. The point 53*a* represents the "neutral axis" in such plane and is located at the midpoint of the line 53. The force F is applied at a distance 54 from the point 53*a*. The moment would be the distance 54 times the force F.

In FIG. 3B, the fastener 5 is engaged by the surfaces 25 and 28 respectively of the jaws 13 and 14. When the wrench is rotated clockwise, the force F is applied to the points 60 and 61. The perpendicular distance between the point 53*a* and the extension of the line of the force F at the point 61 is represented by the number 62. It can be seen that the distance 62 is less than the distance 54. Accordingly, the moment furnished by the wrench 10 is less than the moment furnished by the wrench 10*a*. As a result, the tendency for the more highly stressed jaw 14 to spread or break is less.

Referring back to FIG. 1, the axis of the handle is at an angle of 15° with respect to a plane parallel to the jaw surfaces 17 and 18. This is a common feature of wrenches so that it can be inverted in tight locations. The notches 20 and 21 do not affect the capability of the wrench from being inverted in tight locations.

In other words, the angle between the axis and the horizontal is −15°. The wrench can be inverted so that the wrench axis is at an angle of +15° with respect to the horizontal. The jaw surfaces 17 and 18 can be used to tighten or loosen the fastener, in either orientation. However, the drive surfaces 25 and 28, can only be used to tighten the fastener in the orientation depicted. If the wrench 11 is inverted, the jaw surfaces 25 and 28 are not at the proper location to engage sides of the fastener. Similarly, when the wrench is used to loosen the fastener, the jaw surfaces 17 and 18 are available, whether the wrench is in its non-inverted or inverted orientation. But, the jaw surfaces 25 and 28 are only available when the wrench is in an inverted position.

In the embodiment depicted, the notch 20 is located at the rear of the jaw surface 17, and the notch 21 is located in the middle of the drive surface 18. The notch 21 could be located at the rear of the jaw surface 18, and the notch 20 located in the center of the jaw surface 17. In that case, the normal usage of the wrench would be in its inverted orientation for tightening. In other words, a +15° for tightening as opposed to the −15° orientation depicted in FIG. 1. The notches could be at other selected locations on the jaw surfaces.

In an operative embodiment of the invention, the wrench had the following dimensions, wherein "N" is the across-sides dimension 8:

| Dimension | Value |
|---|---|
| Angle 32 | 162° |
| Distance 33 | .05 N |
| Diameter 35 | 1.155 N |
| Radius 36 | .10 N |
| Angle 38 | 15° |
| Distance 39 | .5775 N |

Figure 4:
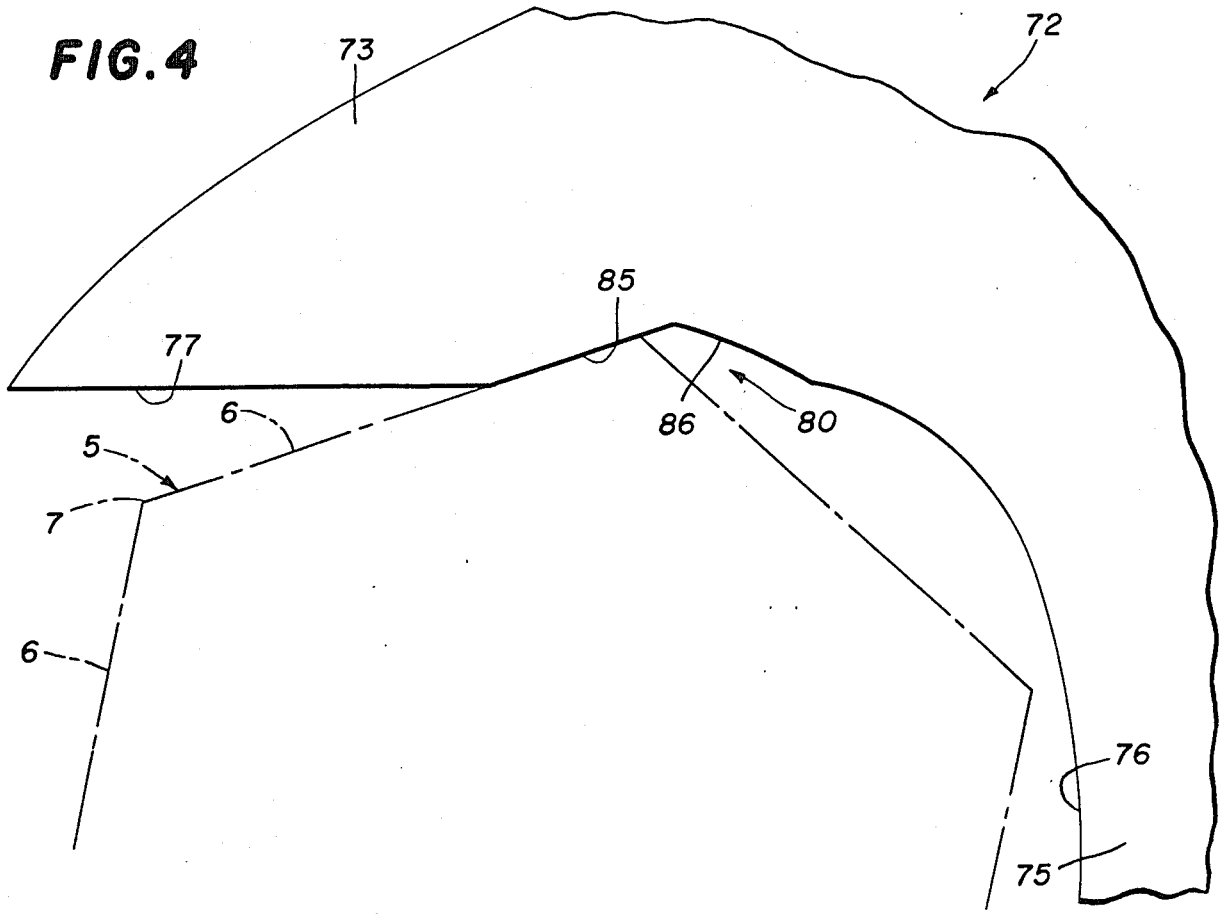
FIG. 4 depicts a fragmentary portion of an open end wrench constructed in accordance with the features of a second embodiment of the present invention.

A second embodiment of the present invention is depicted in FIG. 4. The wrench head 72 is similar to the wrench head 12 depicted in FIG. 2, having a jaw 73 corresponding to the jaw 13, and a jaw (not shown) corresponding to the jaw 14. The jaw 73 has a jaw surface 77 corresponding to the jaw surface 17 and a jaw surface (not shown) corresponding to the jaw surface 18. In the jaw 73 is a notch 80 defined by a drive surface 85 corresponding to the drive surface 25 and a clearance surface 86 corresponding to the clearance surface 26. Thus, the difference between the form in FIG. 2 and the form of FIG. 4 is that the latter does not have a spacing surface. A second notch (not shown) is located in the other jaw and is substantially identical to and a mirror image of the notch 80. The distance between the drive surfaces in this embodiment is the same as the distance in the first embodiment as is the distance between the clearance surfaces and their preferred shapes. Although the surfaces 85 and 86 are shown as intersecting in a line, a blending surface could be employed instead. The surface 85 is extended to intersect with the surface 86. Thus, the surface 85 contacts a corner 7 of the fastener resulting in a greater likelihood of damage to the fastener corners. The wrench head 72 is a substantial improvement over the prior art in that the jaws have less tendency to spread or break during use for the reasons explained above in connection with FIGS. 3A and 3B.

What has been described, therefore, is an improved open-end wrench which has specially configurated notches in the jaw surfaces to reduce the tendency of the jaws to spread or break during use. In one embodiment, the open-end wrench has the further advantage of precluding damage to the corners of the fasteners being tightened.

We claim:

1. An open-end wrench for a fastener having a plurality of generally flat sides intersecting at a plurality of corners, the fastener having an across-sides dimension and an across-corners dimension, said open-end wrench comprising an elongated handle and a wrenching head carried thereby, said head including first and second jaws and a throat interconnecting said jaws, said jaws respectively including first and second planar jaw surfaces substantially parallel to each other and spaced apart a distance slightly greater than the across-sides dimension, said jaw surfaces respectively having first and second notches therein, adapted to simultaneously receive opposing corners of the fastener, each of said notches being defined by a drive surface and a clearance surface adjacent to said drive surface, said drive surfaces being substantially planar and substantially parallel to each other and spaced apart a distance slightly greater than the across-sides dimension, the length of each of said drive surfaces being short compared to the length of a flat side of the fastener, each of said drive surfaces being adapted to engage a portion of a selected side of the fastener near a corner thereof, the distance between said first and second clearance surfaces being slightly greater than the across-corners dimension so that the clearance surfaces cannot engage any portion of the fastener, there being a predetermined angle other than 0° between each jaw surface and the associated drive surface.

2. The open-end wrench of claim 1, wherein said first notch is near said throat and said second notch is generally midway between said throat and the free end of said second jaw.

3. The open-end wrench of claim 1, wherein said throat has a curved surface.

4. The open-end wrench of claim 1, wherein the angle between each jaw surface and the associated drive surface is about 162°.

5. The open-end wrench of claim 1, wherein each of said clearance surfaces is a segment of a circle having a diameter slightly greater than the across-corners dimension.

6. The open-end wrench of claim 1, wherein said elongated handle and said wrenching head are integral.

7. An open-end wrench for a fastener having a plurality of generally flat sides intersecting at a plurality of corners, the fastener having an across-sides dimension and an across-corners dimension, said opened wrench comprising an elongated handle and a wrenching head carried thereby, said head including first and second jaws and a throat interconnecting said jaws, said jaws respectively including first and second planar jaw surfaces substantially parallel to each other and spaced apart a distance slightly greater than the across-sides dimension, said jaw surfaces respectively having first and second notches therein, adapted to simultaneously receive opposing corners of the fastener, each of said notches being defined by a drive surface and a clearance surface and a spacing surface disposed between said drive surface and said clearance surface, said drive surfaces being substantially planar and substantially parallel to each other and spaced apart a distance slightly greater than the across-sides dimension, the length of each of said drive surfaces being short compared to the length of a flat side of the fastener, each of said drive surfaces being adapted to engage a portion of a selected side of the fastener near a corner thereof but spaced therefrom, the distance between said first and second clearance surfaces being slightly greater than the across-corners dimension so that the clearance surfaces cannot engage any portion of the fastener, each of said spacing surfaces being offset into the associated jaw so as not to be able to engage any portion of the fastener, there being a predetermined angle other than 0° between each jaw surface and the associated drive surface.

8. The open-end wrench of claim 7, wherein said first notch is near said throat and said second notch is generally midway between said throat and the free end of said second jaw.

9. The open-end wrench of claim 7, wherein said throat has a curved surface.

10. The open-end wrench of claim 7, wherein the angle between each jaw surface and the associated drive surface is about 162°.

11. The open-end wrench of claim 7, wherein each of said clearance surfaces is a segment of a circle having a diameter slightly greater than the across-corners dimension.

12. The open-end wrench of claim 7, wherein said elongated handle and said wrenching head are integral.

13. The open-end wrench of claim 7, wherein each of said spacing surfaces is a segment of a circle.

14. The open-end wrench of claim 7, wherein each of said spacing surfaces is a segment of a circle centered on a line 15° removed from a line perpendicular to said jaw surfaces.

15. The open-end wrench of claim 7, wherein each of said clearance surfaces is a segment of a circle having a diameter slightly greater than the across-corners dimension, and said spacing surfaces being respectively tangent to the associated clearance surfaces.

* * * * *